United States Patent [19]

Vecchio

[11] Patent Number: 4,834,191

[45] Date of Patent: May 30, 1989

[54] PLOW FOR MOTOR GRADER

[76] Inventor: Charles J. Vecchio, 1728 Stewart Ave., North Bellmore, N.Y. 11710

[21] Appl. No.: 136,731

[22] Filed: Dec. 22, 1987

[51] Int. Cl.[4] ..... E02F 3/815

[52] U.S. Cl. ..... 172/784; 172/815; 172/701.1; 37/281

[58] Field of Search ..... 172/815, 784, 701.1, 172/701.2, 701.3, 811; 37/281

[56] References Cited

U.S. PATENT DOCUMENTS

| | | | |
|---|---|---|---|
| 1,668,850 | 5/1928 | Larsh | 172/784 |
| 1,976,597 | 10/1934 | Bird | 172/815 |
| 2,674,817 | 4/1954 | Palmiter | 172/701.1 |
| 3,028,698 | 4/1962 | Schmitt | 172/701.1 |
| 3,477,151 | 11/1969 | Zanella | 172/815 |

*Primary Examiner*—Richard J. Johnson

*Attorney, Agent, or Firm*—George J. Brandt, Jr.

[57] ABSTRACT

A plow for a motor grader is provided with forwardly pivotable panel members at the two ends of the moldboard so the plow can retain and carry forward removed grade debris without leaving significant windrow residue. The plow also can with suitable forward and backward tilting thereof and panel member extension be used to cut roadways with water run-off inclines or gullies with inclined side walls at the same time.

10 Claims, 6 Drawing Sheets

PLOW FOR MOTOR GRADER

BACKGROUND OF THE INVENTION

The grading operations which can be carried out with a motor grader are diverse. The grader, for example can be employed to cut down and level a slope to provide a generally flat tract. It can be used to cut a road along a desired course or it can be used for such a simple task as transporting material from an accumulated stock from one location to another. This versatility of the motor grader stems from the construction thereof which allows a wide three-dimensional positioning of the grading plow. The plow, carried on a drawbar structure, can be rotated 360 degrees in a horizontal plane, it can be tilted forwardly or rearwardly relative to a horizontal plane (grade) and can along with the framing on which it is mounted, be tilted (relative to said plane) to the left and to the right to dispose the plow at an angle to the horizontal. Further, the plow can be translated or slid relative to its mounting.

There are however certain limitations in the use of a motor grader fitted with known types of plows. For example, in cutting a road it is not possible to cut or grade the road surface and downwardly inclining run-off surfaces commonly required at each of the road sides in the same grading pass. Thus, the grader must following a road , be returned to a starting point, the plow angled to correspond to a run-off cut disposition and then driven forwardly in a new cutting pass to grade the run-off. Another limitation is encountered where grading in multiple passes over an expansive area is carried out. In such operations, the plow usually will be angled to the right or left of the long axis of the grader. As the grader makes cutting passes removed grade material travels from the toe end to the heel of the plow and substantial quantity of material passes off at the heel leaving a windrow thereof along the cutting pass margin. This windrow must then be carried forward in the next pass but the windrow spillage process repeats itself. Thus extra passes of the grader must be made if ultimately all cut material is to be removed from initial to final tract locations.

In grading along a curb line where the plow will be angled to the right or left, spillover of material at the toe end of the plow to the rear side of the plow can occur as a cascading deposit onto the curbing frame requiring that extra labor be used to clear debris from the frame. Also, a conventional plow has only limited movement possibility when grading the environs of manhole frames and sewer boxes adjacent curb lines necessitating unneeded and multiple grader movements in and around such structures.

In addition to the foregoing, the conventional plow cannot present a configuration thereof which can retain and carry forwardly any significant quantity of cut grade material plows which can be folded to define material holding space are known. For example, bulldozer and snow plow blades comprised of two equal length blade halves pivoted together can be angled about the pivot from a flat front face plow disposition to a V-configuration to form a retention space with the folded halves. However, such retention space has limited volume and such plow cannot be angled or tilted in any of the many other plow configurations commonly used and/or required in a motor grading operation.

SUMMARY OF THE INVENTION

The present invention provides an improved grading plow construction and the use of which enlarges the scope of grading operations possible with motor graders and further makes such operations efficient and economical.

In accordance with the invention, the plow which is mountable on a conventional motor grader drawbar frame comprises an elongated moldboard of, e.g., arcuate cross section, and constituted of a unitary component having opposite moldboard end sections and a central section intervening these end sections. Panel members of elongate character are carried on each of the moldboard end sections, the panel members being pivoted at an end of each to the moldboard proximate, the junctures of the mold-board central section with the moldboard end sections The panel members each can locate in a first position wherein they lie flat against the associated moldboard end section closely snubbed therewith. In this configuration the panel members function in cooperation with the moldboard central section in the same manner as a conventional plow so that if the plow be angled to make a grading cut, one panel represents the toe end of the plow and the other the heel. Material removed in the cutting pass travels from the toe to the heel in the usual fashion.

The panel members are on the other hand, movable forwardly on the moldboard from first position to a second held or locked position wherein they dispose at an acute angle with the moldboard and section, such panel member movement being effected with suitable power means such as hydraulic cylinder units and further such that one panel member can be moved independently of the other. This capability of so disposing the panel members alters the basic plow geometry to configure it to define a plow debris or material retention space wherein cut material can collect and be retained as the grader moves forwardly in a grading pass. This reduces and in some instances depending on the depth of cut being taken can eliminate formation of material spill-off windows at the end of the plow. Since more removed material is carried forward in a pass there is ultimately a reduction in the time and number of grader passes involved in a particular grading task.

In the requirement for cutting a crowned road or a gully, the moldboard can be tilted forwardly or rearwardly relative to the vertical and crosswise to grader travel and the two panels be extended to second position. In such configurations, the panel lower cutting edges will be situated either below or above the moldboard central section cutting edge. In this manner, a forward pass travel of the grader will result in either a road with downwardly directed run-offs or a gully with upwardly inclining side walls being cut at the same time, again increasing the productivity attending the grading operation.

When grading at a curb is required, the plow will be inclined relative to the longitudinal axis of the motor grader and then the panel member at the toe end of the plow extended to second position. The thus extended toe end panel presents a sharper angle of attack to the grade surface and results in more positive impelling of removed material along the moldboard reducing the likelihood that spillover of material at the toe end of the plow can occur and deposit on the curb frame.

The mounting of the panel members in one embodiment can be effected with a pair of pivot blocks fixed to the moldboard at each of the junctures of the moldboard end sections with the central section. A cooperating pair of hinge blocks is carried on each panel member and one of the hinge blocks in each of these last-mentioned blocks includes a crank extension swing to the rear of the so that such crank extension can be connected to the movable rod of a hydraulic cylinder unit.

To facilitate bridging flow of debris moving from the moldboard central section onto an adjacent panel member when that panel member is in folded first position, a fairing plate extending transversely of the moldboard is fixed thereto adjacent the panel pivoting location, the fairing plate inclining from the moldboard front face surface outwardly to substantial merger with the panel member front face.

Other objects and advantages of the invention will be detailed in the description to be given below.

BRIEF DESCRIPTION OF THE DRAWINGS

The invention will be further described with reference to the accompanying drawings in which.

Throughout the following description, like reference numerals are used to denote like parts in the drawings.

DESCRIPTION OF THE PREFERRED EMBODIMENTS

Figure 1:
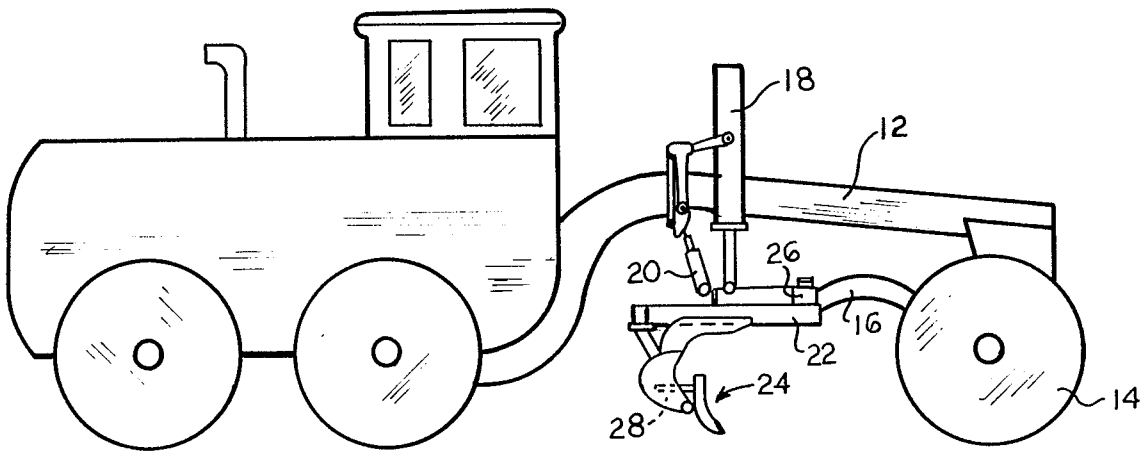
FIG. 1 is a side elevational view of a motor grader fitted with an improved plow made in accordance with the present invention.

Referring to FIG. 1, motor grader 10 is a known type including forward main chassis frame 12 supported on front wheels 14 and to which is mounted a drawbar assembly 16 in the usual manner, i.e., the drawbar can pivot toward and away from the viewer about a longitudinal axis of the grader and it also can pivot up and down about the pivot of the drawbar forward connection to the grader, i.e., it can pivot clockwise and counterclockwise as viewed in FIG. 1. This pivoting can be effected in combination of movements of hydraulic cylinder units 18,20 carried on chassis frame 12 and connected with the drawbar assembly. The drawbar assembly also includes a rotatable ring member 22 to which is mounted a grading plow shown generally at 24, the ring member having an internal gear formed therein which is in mesh with a fixed pinion (not shown) driven by hydraulic motor 26. Thus, the ring member and hence the plow, can be rotated 360 degrees about the horizontal or surface to be graded to position the plow in a desired work position. In addition, the hydraulic cylinder units 18,20 can be operated to provide additional specific plow orientation as may be required for a given grading requirement depending on whether the grading is of a slope, relatively flat land space etc. The foregoing motor grader construction is well known to those skilled in the art. Further, a hydraulic cylinder unit as shown at 28 can be used to forwardly and rearwardly tilt the plow in known manner.

Figure 2:
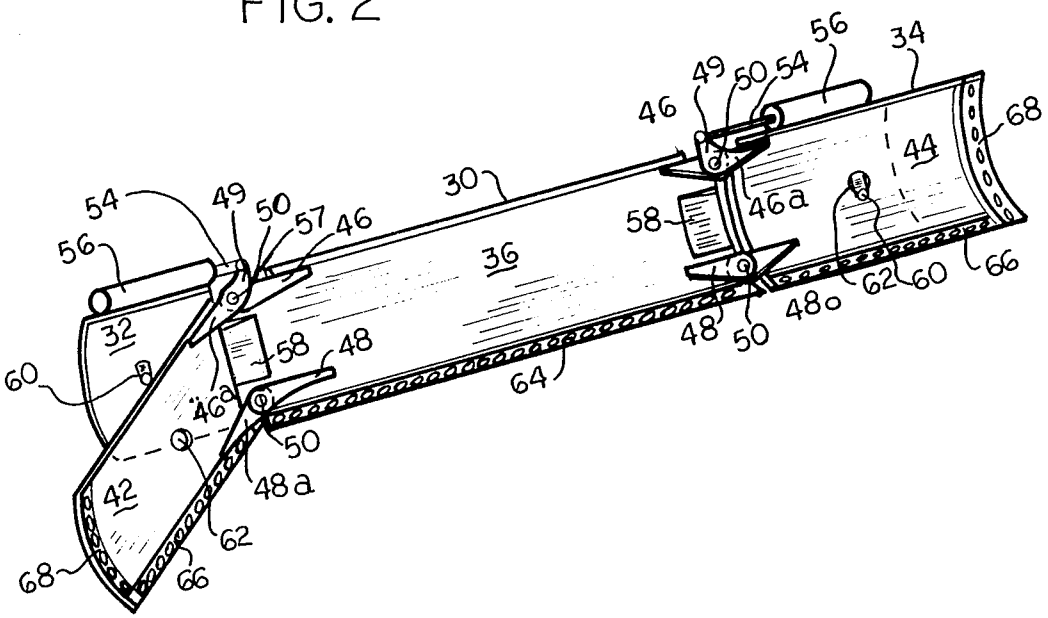
FIG. 2 is a perspective view of the plow showing one panel member in second and the other in first positions.
Figure 3:
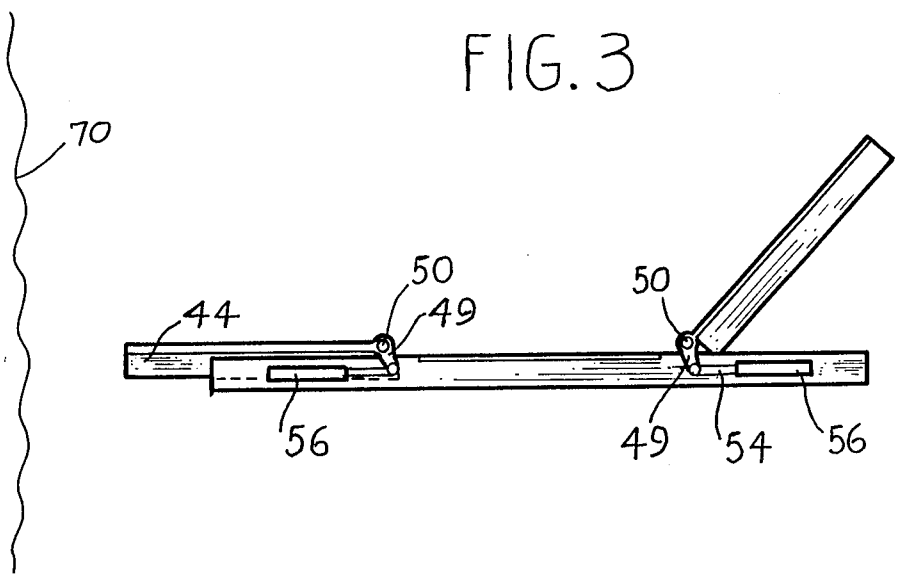
FIG. 3 is a top plan view of the FIG. 2 configuration illustrating the locations at which the free ends of the panel members locate relative to corresponding ends of the moldboard in the respective panel positions.

The plow 24 is of the construction shown in FIGS. 2–5 and continuing reference will be had to these Figures now in describing the plow. The plow includes an elongated arcuate cross section moldboard 30, the moldboard having two opposite end sections 32,34 intervened by and joined in unitary structure with a central moldboard section 36. Panel members 42,44 are carried on the respective moldboard end sections 32,34 and are of elongate character, the panel members each being pivoted at one end to the moldboard proximate the junctures of the respective end sections with central section 36. The panel members each have first positions in which they nest closely snubbed or folded against the associated moldboard end sections and they have lengths which are greater than the moldboard end sections so that when in first position the other end of each extend some distance longitudinally (e.g., 8" to 12") beyond a corresponding end of the moldboard, this being evident from the positioning of panel member 44 as seen in FIGS. 2 and 3. The panel members can be moved forwardly of the moldboard to selected second positions of each, the extreme range of the forwardly located second positions( up to 45 degrees with the moldboard end sections) being exemplified with respect to the showing of panel member 42 in FIGS. 2 and 3. In the extreme second positions of the panel members as well as any intermediate forward position, the tip ends of the panel members are still situate some distance longitudinally of a corresponding end edge of the moldboard insuring that it is always the panel member tip end and not the tip end of the moldboard which lies closely adjacent any vertical barrier, e.g., a curb frame when grading at a curb line.

The panel members 42,44 are pivoted to the moldboard with hinge members fitted to each. Thus a pair of hinge pieces 46,48 are rigidly connected as by welding to the moldboard proximate the )junctures of the moldboard end sections and the central section. Companion hinge pieces 46*a* and 48*a* are carried on the respective panel members and pivot pins 50 pass through the hinge pieces. One of the hinge pieces connected to the panel members, i.e., each hinge piece 46*a*, carries a crank extension 49 which passes to the rear side of the moldboard where the extension is fixed to the rod 54 of a hydraulic cylinder unit mounted on the rear of the moldboard. The hydraulic cylinder units 56 are operable independently one of the other from the hydraulic system of the motor grader. In the depicted embodiment, it will be seen that the cylinder unit rods 54 are fully retracted to extend the panel members forwardly and the rods are extended from their associated cylinders to retract the panel members against the moldboard end sections, the cylinder units being suitably controlled in known manner to hold the panel members in any given or selected second position. The hinge members 46,48,46*a* and 48*a* are tapered and otherwise smoothly contoured to reduce the obstruction same present to material flow along the moldboard when, e.g., the plow is used in the manner of a conventional plow, i.e., when the panel members are retracted.

Since the panel members in retracted position present a forwardly positioned structure relative to the moldboard, it is desirable that smooth flow of material moving from the moldboard central section toward the heel of the plow be provided. For this purpose fairing plates 58 are fitted to the moldboard adjacent the pivoted ends of the panel members. These fairing members extending transversely of the moldboard have inclined faces which thicken from minimum dimension at the moldboard face to maximum thickness corresponding substantially with that of the panel members where they confront in juxtaposition with the panel member end edges.

The moldboard 30 also carries in the end sections thereof stress relieving pins 60 which are fixed to the moldboard and can, e.g., taper forwardly so that these pin members cooperate with companion openings 6 in the panel members. When the panel members are retracted the pins locate closely in the openings and this arrangement allows the pins to absorb any shock transmitted to the hinges, cylinder units, mountings etc., when the plow is used in making grading cuts of hard surface material and wherein the panel members will be retracted. Grading cuts can of course be made with the panel members extended, the limitation in that instance being the depth of cut and the type of surface involved.

As will be seen in FIG. 2, the moldboard central section is fitted at the lower edge with a readily removable and replaceable cutting edge 64. Similar cutting edges 66 are provided on the panel members 42, 44 and the panel members also carry vertical cutting edges 68 at their tip end transverse margins.

As noted above, the plow 24 can be used in conventional fashion wherein both panel members 42,44 will be in first positions of each. It can be used in other configurations wherein one or both of these panel members are extended. Some of these utilizations will be discussed below and with reference to FIGS. 6–11.

Figure 6:
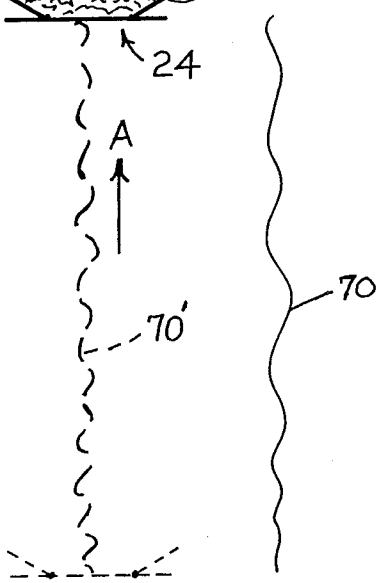
FIG. 6 is a diagrammatic depiction of use of the plow in material carrying configuration wherein prior produced windows created incident grading are eliminated by use of the plow without further windrow creation in a carrying pass.
Figure 4:
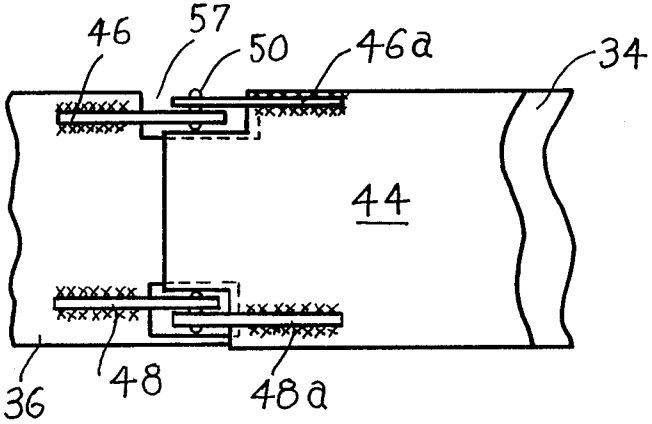
FIG. 4 is a fragmentary front elevational view on enlarged scale depicting the hinge mounting of a panel member to the moldboard.
Figure 5:
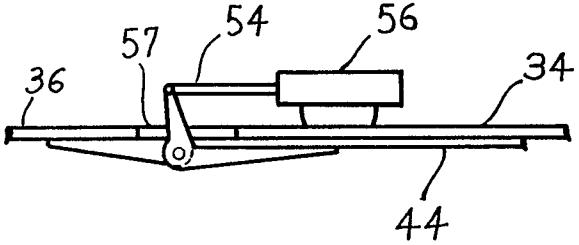
FIG. 5 is a top plan showing of FIG. 4.

FIG. 6 shows how the plow 24 is used to clean up windows 70 on a site which has already been graded and incident such grading, one or more of such windows 70 result consequent spillage of graded material off the heel of the grading plow. For this operation, the two panel members 42, 44 will be extended forwardly and they will with central section 36 define a plow enclosure space in which substantial quantity of material can be retained by the plow as it is moved forwardly. As seen in FIG. 6, the material in windrow 70' has been taken up in the plow retaining space 72 and carried forward to location 73 where it is deposited for further disposal etc. If a conventional plow was used to move windrow 70' there would regardless of blade angulation relative to travel direction A, result in a spillage of material at one or both ends of the plow leaving new windows. This FIG. 6 use of the plow eliminates unneeded cleanup passes with the grader when eliminating windows.

Figure 7:
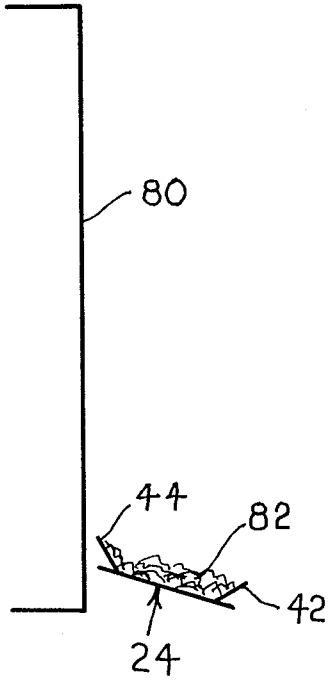
FIG. 7 is a diagrammatic depiction showing use of the plow in a grading operation at a curb line.

FIG. 7 shows use of the plow for grading at a curb line 80. The plow 24 can be angled, e.g., so that the left end is the toe end for working the left side curb line. The panel members 42,44 will be extended and the principal cutting action will be effected by panel member 44. Panel member 42 will serve principally as a retention component. As the grader moves forwardly the plow will cut the grade at the curb line and because panel member 44 presents a sharp angle of attack to the grade surface removed material will be impelled along the panel member 44 onto the moldboard central section with little likelihood that such removed material will roll over the moldboard toe end and onto the curb frame. A conventional plow set in similar orientation presents a flatter angle of attack and less material sideways flow momentum so the possibility of rollover at the toe end is greater. In this configuration of plow 24 it also functions to retain substantial amounts of debris as at 82 so as to carry it forwardly thereby reducing windrow formation at the heel of the plow.

Figure 8A:
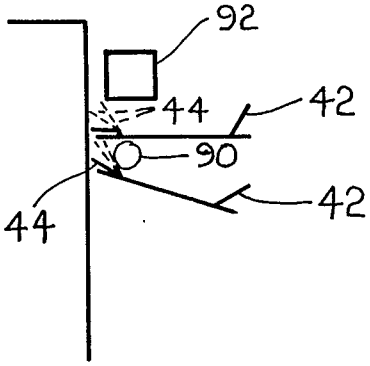
FIG. 8*a* is a view depicting another positioning of the plow in the FIG. 8 operation.
Figure 8:
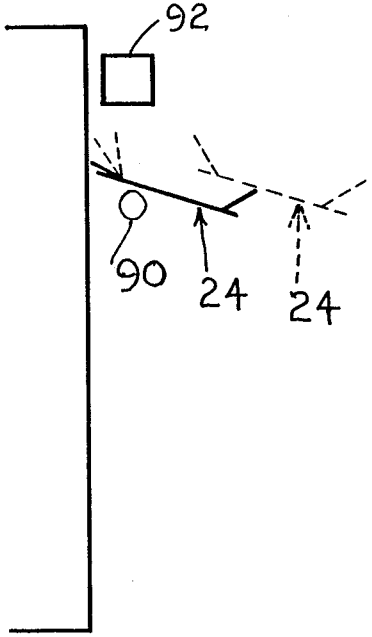
FIG. 8 is a view similar to FIG. 7 showing special adaptability for working in and around manhole frames, sewer boxes and like upstanding obstructions which can be present in a grading course.

FIGS. 8 and 8*a* illustrate another use and particularly plow adaptability for grading around obstructions such as manholes 90, sewer boxes 92, etc. as are commonly located along a curb line. To effect grading in this confined space, the grader will be stopped and the plow translated leftwardly on the grader mounting frame to access the space. Panel 44 will be in first position. When panel member 44 is there after moved to second extreme position as shown in dashed lines, such movement will scoop-grade material rightwardly to cut the grade. The plow can then be translated rightwardly to the position shown in long and short lines to further grade cut the space and also carry cut material away from the space between the manhole and the sewer box. A conventional plow cannot be used as efficiently for this purpose as the plow of the invention.

FIG. 8*a* shows two additional ones of the many other accessing dispositions the plow can be given when grading near, e.g., the manhole 90. The upper horizontal plow orientation allows reach in a right to the curb line for scoop grading above the manhole. The lower plow orientation shows how the panel member 44 when worked back and forth between first and second positions can be used to scoop grade the area in between the manhole and the curb line.

Figure 9A:
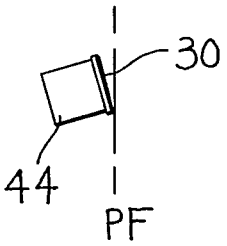
FIG. 9*a* is a side elevational view of FIG. 9 illustrating forward tilting of the plow to produce the cutting edge dispositions required to effect simultaneous cutting shown in FIG. 9.
Figure 9:
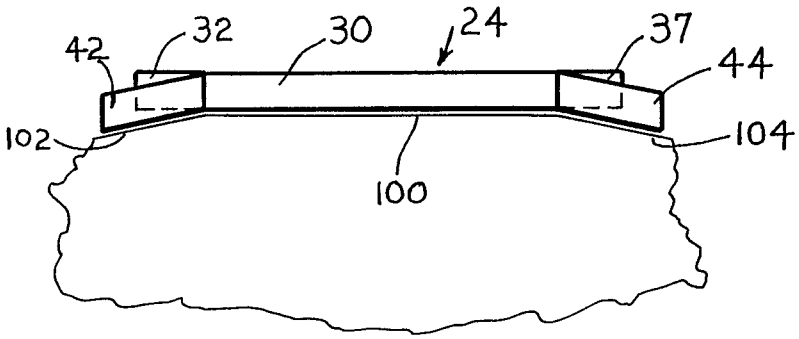
FIG. 9 is a diagrammatic depiction of a road grading operation wherein the plow is employed to cut the road surface and water run-off paths at each side of the road in the same pass.

FIGS. 9 and 9*a* show use of the plow to simultaneously cut a roadway grade 100 and water run-off inclines 102, 104 at the roadway margins at the same times. For this purpose, the moldboard will be inclined in a forward direction from vertical axis PF resulting in similarly shifting the pivoting axes of the panel members so that when the panel members are extended they skew below the horizontal edge of the moldboard central section and locate at an incline thereto that allows for cutting the roadway surface and run-off inclines at the same time. Three separate passes of a grader fitted with a conventional plow would be required to duplicate the single pass of plow 24.

Figure 10A:
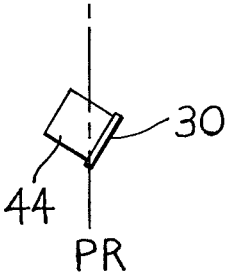
FIGS. 10 and 10*a* correspond to FIGS. 9 and 9*a* except the plow has been tilted rearwardly to cut a gully with upwardly inclined side walls simultaneously in the cutting pass.
Figure 10:
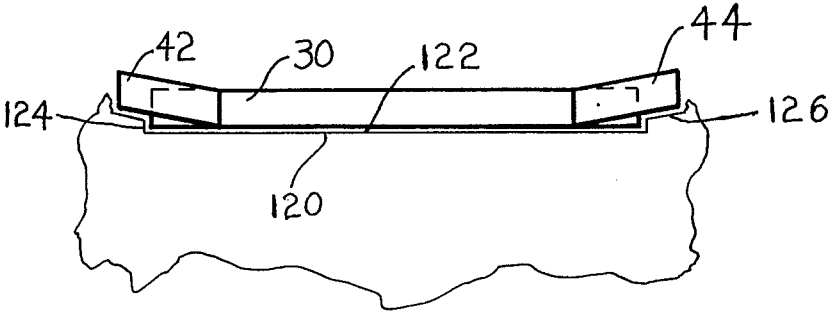

FIGS. 10 and 10*a* show the manner in which a gully 120 can be formed with plow 24 so as to cut at the same time the gully base surface 122 and upwardly inclined side wall confines 124, 126. In this configuration the plow will be tilted so that its moldboard is inclined rearwardly of vertical axis PR and the panel members moved to extended positions, the panel members serving to cut the inclined walls.

Figure 11:
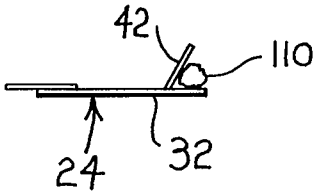
FIG. 11 is a fragmentary plan view illustrating a further utility of the plow as a lifting device to remove large objects such as boulders from a grading area.

FIG. 11 shows the further utility plow 24 possesses. Thus a boulder 110 can be girded between the rear face of extended panel member 42 and the front face of moldboard end section 32. By retracting the panel member, a clamping force is applied to hold the boulder and it can be carried off by the grader to a deposit location.

Those skilled in the art readily recognize that various modifications can be made to the plow construction without departing from the scope of the inventive concept disclosed.

What is claimed is:

1. A plow for a motor grader and the like, said plow comprising an elongated moldboard, said moldboard having a cross-section of arcuate configuration with the moldboard presenting curved front and rear faces, first and second hinge means carried on the moldboard at the front face thereof, one hinge means being located a distance from one end of the moldboard and the other hinge means located a distance from the opposite end of the moldboard, a pair of panel members, the respective panel members being pivotably connected at an end thereof to the respective ones of the hinge means, and power means carried on said moldboard and connected with said panel members for pivoting said panel members between first and second operating dispositions thereof, the panel members each having an arcuate cross-section so that when in said first operating disposition the panel members lie nested against end portions of the moldboard front face in covering closely conformable contact therewith and define with the moldboard a substantially conventional plow configuration, the panel members in said second operating disposition disposing forwardly of said moldboard end portions at an acute angle therewith and defining with the moldboard front face portion intermediate said hinge means a plows retention space wherein graded material can be retained on the plow as it is moved in a grading pass over a surface being graded.

2. The plow of claim 1 in which each panel member is of such length that when disposed in first operating disposition an opposite end of the panel member extends longitudinally a distance beyond a corresponding end of said moldboard.

3. The plow of claim 2 in which each panel member length is such that in said second operating disposition the said opposite end thereof locates longitudinally beyond the corresponding moldboard end.

4. The plow of claim 3 in which the moldboard has top and bottom longitudinal edges, said plow further comprising a cutting edge member carried on the moldboard bottom edge intermediate said first and second hinge means, each panel member having a bottom edge and a cutting edge member carried at said panel member bottom edge.

5. The plow of claim 4 in which each panel member carries a transversely directed cutting edge at its other end.

6. The plow of claim 5 in which the said cutting edges are readily removable/replaceable components.

7. The plow of claim 2 in which said power means is operable to move said panel members from first to second disposition thereof in a range of such second dispositions and hold said panel members in a selected disposition.

8. The plow of claim 7 in which said power means are a hydraulic cylinder units disposed at the rear face of the moldboard.

9. The plow of claim 8 in which the first and second hinge means comprises for each a pair of hinge pieces fixed to said moldboard, there being a second pair of hinge pieces fixed to said end of a panel member and rotatably connected with said first hinge piece pair, the hydraulic cylinder unit associated with each panel including a sliding rod, one of said hinge pieces of said second pair including a crank extension extending to the rear face of the moldboard and being connected to the sliding rod.

10. The plow of claim 1 in which the moldboard carries fairing plates on the moldboard front face and extending transversely thereof adjacent the hinge means, said fairing plates each having a face surface inclining from minimum thickness thereof at the moldboard front face to a maximum thickness adjacent an edge thereof which disposes juxtaposed with an end edge of its associated panel member when said panel member is in said first operating disposition so that material moving along the moldboard in the direction of said panel member can pass onto the panel member with minimized obstruction to said flow.

* * * * *